US008500661B2

(12) United States Patent
Greenberg

(10) Patent No.: US 8,500,661 B2
(45) Date of Patent: Aug. 6, 2013

(54) APPARATUS AND METHOD OF BODY CONTOURING AND SKIN CONDITIONING

(76) Inventor: Allan Ronald Greenberg, Woodforde (AU)

( * ) Notice: Subject to any disclaimer, the term of this patent is extended or adjusted under 35 U.S.C. 154(b) by 1388 days.

(21) Appl. No.: 11/886,079

(22) PCT Filed: Mar. 9, 2006

(86) PCT No.: PCT/AU2006/000305

§ 371 (c)(1),
(2), (4) Date: Jan. 4, 2008

(87) PCT Pub. No.: WO2006/094348

PCT Pub. Date: Sep. 14, 2006

(65) Prior Publication Data

US 2008/0091126 A1 Apr. 17, 2008

(30) Foreign Application Priority Data

Mar. 9, 2005 (AU) ..... 2005901111

(51) Int. Cl.
*A61H 7/00* (2006.01)

(52) U.S. Cl.
USPC ..... 601/6; 601/9

(58) Field of Classification Search
USPC ..... 601/6–14, 146, 148, 150
See application file for complete search history.

(56) References Cited

U.S. PATENT DOCUMENTS

| | | | | |
|---|---|---|---|---|
| 2,234,102 | A * | 3/1941 | Andres | 601/101 |
| 2,526,190 | A * | 10/1950 | Alvarez | 601/17 |
| 2,571,398 | A * | 10/1951 | Wheeler | 601/9 |
| 2,655,145 | A * | 10/1953 | Heger | 601/17 |
| 3,841,323 | A * | 10/1974 | Stoughton | 601/10 |
| 4,428,368 | A * | 1/1984 | Torii | 601/9 |
| 5,003,966 | A * | 4/1991 | Saka et al. | 601/13 |
| 6,706,006 | B2 * | 3/2004 | Kostrov et al. | 601/9 |
| 2001/0041848 | A1 * | 11/2001 | Ito et al. | 601/6 |
| 2003/0216672 | A1 * | 11/2003 | Rastegar et al. | 601/9 |
| 2004/0073144 | A1 * | 4/2004 | Carava | 601/6 |
| 2004/0260209 | A1 * | 12/2004 | Ella et al. | 601/7 |

* cited by examiner

*Primary Examiner* — Michael A. Brown
(74) *Attorney, Agent, or Firm* — Christopher C. Dremann; Christopher Dremann, P.C.

(57) ABSTRACT

The present invention provides an apparatus and method of body contouring and skin conditioning. The apparatus 10 treats cellulite and the like by producing vibrations in the subcutaneous layers of fat. A cup 18 of handpiece 16 is placed against the skin to create a chamber 60. A vacuum source 160 and compressor 162, which are in communication with chamber 60, are then controlled to produce an oscillating pressure within the chamber 60. This vibration of the skin surface is transferred through the dermal layers thereby influencing fluid retention and cellulite build up.

16 Claims, 13 Drawing Sheets

10

APPARATUS AND METHOD OF BODY CONTOURING AND SKIN CONDITIONING

CROSS REFERENCE TO RELATED APPLICATIONS

This application is filed pursuant to 35 U.S.C. §371 as a United States National Phase Application of International Application No. PCT/AU06/000305, filed Mar. 9, 2006, which claims priority from Australia Application No. AU 200590111, filed Mar. 9, 2005.

BACKGROUND OF THE INVENTION

Cellulite is a skin condition often described as an 'orange peel', 'mattress', or 'dimpling' that appears primarily on the thighs, buttocks and sometimes lower abdomen of otherwise healthy people. Research has suggested that 95 percent of women will experience some level of cellulite at some time in their life. The condition may also affect men, however, this is not as common. Cellulite includes fat and fluids that have been trapped in connective tissue pockets beneath the skin.

The outermost layer of skin is referred to as epidermis. Below the epidermis is the dermis, which contains hair follicles, sweat glands, blood vessels, nerve receptors and connective tissue. Underneath the dermis is the first of three layers of subcutaneous fat. The uppermost layer of subcutaneous fat has been described as "standing fat-cell chambers" separated by connective tissue. Small projections of fat cells protrude from the fat-cell chambers into the dermis. This unevenness and irregularity of the subcutaneous fat gives skin the bumpy appearance which is commonly referred to as cellulite.

Water retention and fat build up in the adipose tissue results in an irregular or swollen appearance of a person's skin. The adipose tissue provides insulation and is divided into lobes by small blood vessels. The cells of this layer are adipocytes which are specialized in storing energy as fat.

It is believed that a good eating plan, increased activity, good posture and low stress levels can reduce water retention and fat build up. However, these aspects have limited effectiveness in treating cellulite. Various treatments have also been developed to treat cellulite or adipose tissue including creams, laser technologies, liposuction, and mesotherapy. Mesotherapy involves the use of hair thin needles to inject micro mixtures of vitamins, amino acids, supplements and pharmaceuticals into the middle layer of skin, in an attempt to break down fat cells and increase blood flow. Although the needles used in mesotherapy are thin, many people avoid this treatment because they are afraid of needles or the risk of disease, such as AIDS. Cream treatments are seen to be of limited usefulness and treatments like liposuction and mesotherapy are either expensive or may produce only temporary improvement. Many doctors even warn that liposuction is not an effective treatment for cellulite because liposuction is designed to remove deep fat instead of cellulite or adipose tissue, which is close to the skin surface.

A recently developed non-invasive cellulite reduction technique has been given the name Endermologie. Endermologie works by utilizing a device that sucks onto the skin while two rollers aggressively massage the underlying tissue. It has been suggested that about one third of patients will be able to benefit from this deep massage technique. Endermologie does however have its limitations. The strength of the massage is not suitable for some people and temporary bruising often occurs. Furthermore, the method is not suitable for women who are pregnant, have sensitive skin, or those with high blood pressure. One of the other problems with Endermologie is that the operator needs to be skilled so that they do not overly apply pressure thereby bruising the skin. The pressure needed to be applied by the operator may also result in a repetitive stain injury.

It is an object of the present invention to provide for an apparatus and method of body contouring and skin conditioning that overcomes at least some of the aforementioned problems or provides the public with a useful alternative.

It is a further object of the present invention to provide for an apparatus and method of body contouring and skin conditioning that produces vibration in the layers of subcutaneous fat.

SUMMARY OF THE INVENTION

Therefore in one form of the invention there is proposed an apparatus for body contouring and skin conditioning using a suction device, including:

a pressure differential device adapted to produce a pressure differential;

a handpiece having a passageway therethrough, wherein the handpiece is in communication with said pressure differential device; and a cup, adapted to releasably engage said handpiece, having at least a first and second opening, wherein said first opening is defined by a perimeter which when placed against a skin surface defines a chamber, and said second opening is in communication with said handpiece; whereby an oscillating pressure is produced within said chamber which causes said skin to vibrate.

In a further form of the invention there is proposed an apparatus for body contouring and skin conditioning using a suction device, including:

a source of compressed gas adapted to produce a stream of compressed gas;

a vacuum source adapted to produce a vacuum; a handpiece having a passageway therethrough, wherein the handpiece is in communication with said source of compressed gas and said vacuum source; a valve adapted to selectively control the communication of said source of compressed gas and vacuum source with said handpiece; and a cup, adapted to releasably engage said handpiece, having at least a first and second opening, wherein said first opening is defined by a perimeter which when placed against a skin surface defines a chamber, and said second opening is in communication with said handpiece; wherein an oscillating pressure is produced within said chamber thereby causing said skin to vibrate.

Preferably, the cup is adapted to slidably engage said handpiece. More preferably the handpiece includes at least one O-ring which is configured to frictionally engages an inner surface of said cup. Most preferably, cups of different dimensions can be selectively attached to said handpiece.

Preferably, the apparatus includes a plurality of handpieces having different sized cups. The different handpieces can be selectively operated or alternatively the different handpieces can be simultaneously operated.

Preferably, said source of compressed gas is an air compressor. Alternatively, said source of compressed gas is a cylinder of compressed gas.

Preferably, the oscillating pressure within said chamber can be adjusted. More preferably, said apparatus includes a foot pedal adapted to operate control said oscillating pressure.

Preferably, said apparatus includes at least one control valve adapted to alter the pressure within said chamber. More preferably said apparatus includes a release valve or override valve for increasing the pressure within said chamber.

Preferably, said handpiece is connected to said source of compressed gas and vacuum source by way of a flexible hose.

In preference, said apparatus includes a device for applying a therapeutic substance to said skin.

Preferably, said apparatus includes a temperature regulator for affecting the temperature of said skin during operation of said apparatus.

In yet a further form of the invention there is proposed a method of body contouring and skin conditioning using an apparatus as in claim 1 or 2, including the steps of:

placing the cup onto a skin surface, whereby said first opening contacts the skin surface thereby defining a chamber; and activating said apparatus to create an oscillating pressure within said chamber thereby causing tissue layers to vibrate.

Preferably, the vibrations are strong enough to affect the subdermal tissue.

More preferably, the oscillating pressure is adjustable.

Preferably, the frequency of the pressure oscillations can be adjusted.

Most preferably, cups are of different shapes and sizes can be attached to the apparatus to facilitate the tailoring of the body contouring and skin conditioning to the specific physiological attributes of a patient.

BRIEF DESCRIPTION OF THE DRAWINGS

The accompanying drawings, which are incorporated in and constitute a part of this specification and, together with the description, serve to explain the advantages and principles of the invention. In the drawings.

DESCRIPTION OF THE PREFERRED EMBODIMENTS

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

Figure 1:
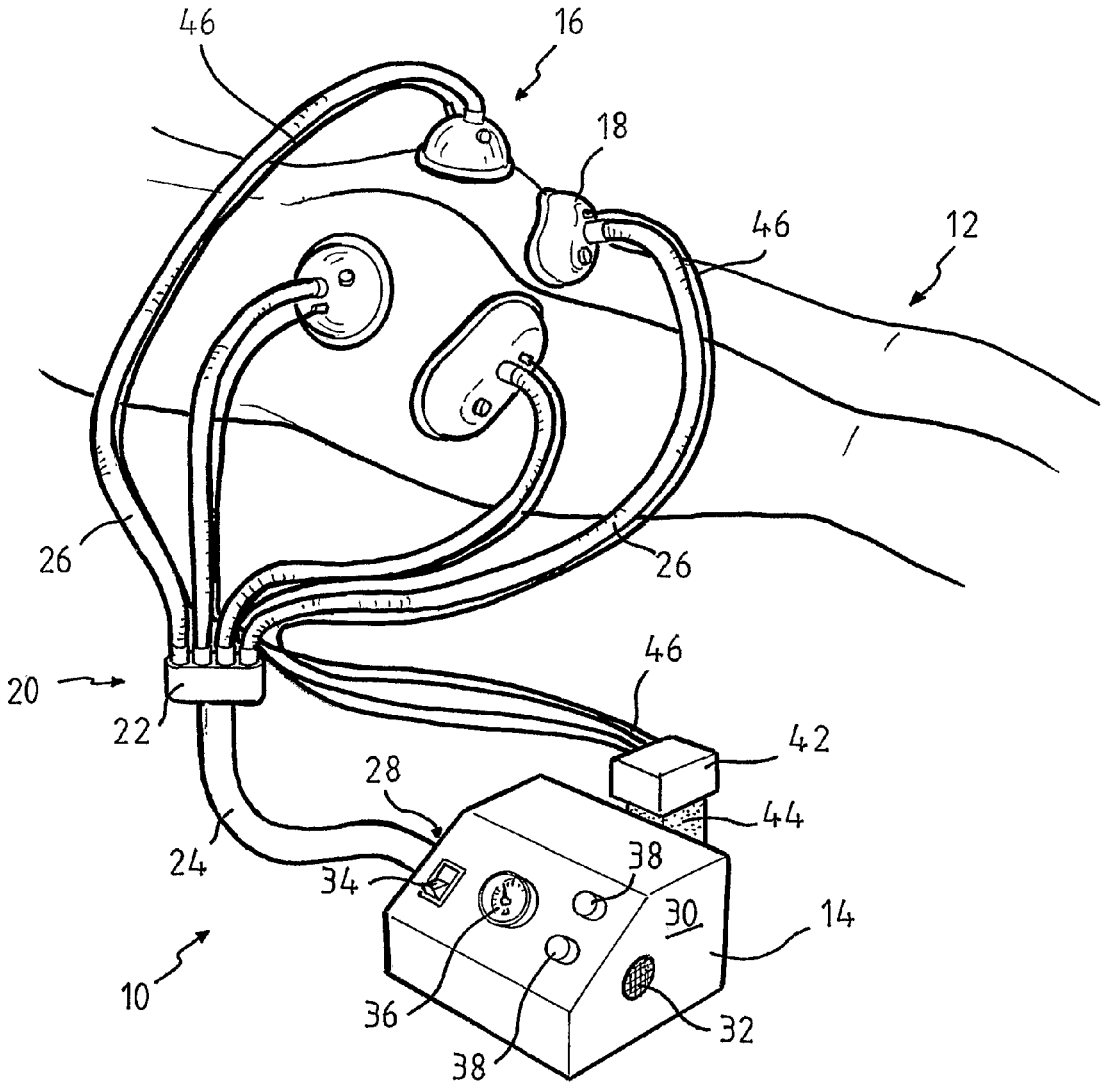
FIG. 1 is a perspective view illustrating an apparatus for contouring and skin conditioning having a plurality of treatment devices.

Illustrated in FIG. 1 is an apparatus 10 for the body contouring and skin conditioning of a patient 12. The apparatus 10 includes a vacuum/compressor source 14 and a plurality of handpieces 16 each of which includes a cup 18 adapted to engage the surface of a patient's body 12. The handpieces 16 are connected to the vacuum/compressor source 14 via connection means 20. As illustrated in FIG. 1, the connection means 20 may include an intermediary multiple adaptor 22 that connects a primary tube 24 to a series of secondary tubes 26. The primary tube 24 is connected to the inlet 28 of the vacuum/compressor source 14, while the secondary tubes 26 are connected to handpieces 16. The reader should however appreciate that each cup may be individually connected to the vacuum/compressor source 14 via a separate tube (not shown).

As clearly illustrated in FIG. 1, several cups 18 can be placed in different locations on the patient 12 during treatment. This enables the time of treatment to be reduced and ensures that problem areas are targeted by leaving the relevant cup 18 in place for longer. The present method also ensures that sensitive areas are not treated for extended periods of time which may result in skin irritation or bruising.

The vacuum source 14 includes a housing 30, an aperture 28 connected to tube 24, a vent 32, a switch 34 adapted to operate vacuum/compressor source 14, a gauge 36 adapted to measure the pressure differential produced by vacuum/compressor source 14, and control valves 38 adapted to alter the strength and frequency of the pressure differential produced by the vacuum/compressor source 14 during operation. The reader should appreciate that the vacuum/compressor source 14 may be connected to mains power or may have an enclosed battery to provide greater portability. Although we refer to a vacuum/compressor source 14 any device may indeed be used to create a pressure differential.

The apparatus 10 may further include a supply container 42 that contains a therapeutic substance or substances 44. The supply container 42 is connected to the handpieces 16 via tubes 46. In this way the therapeutic substances 44 are drawn out of the supply container 42 by the vacuum produced by the vacuum/compressor source 14. It should however be appreciated by the reader that the apparatus 10 may include a motorised dispelling means (not shown) that disseminates the therapeutic substances 44 within the handpieces 16. In this way, as illustrated in FIG. 2, jets 48 of substance 44 may be sprayed from an outlet 50 onto the patient 12 during operation of the apparatus 10.

Figure 2:
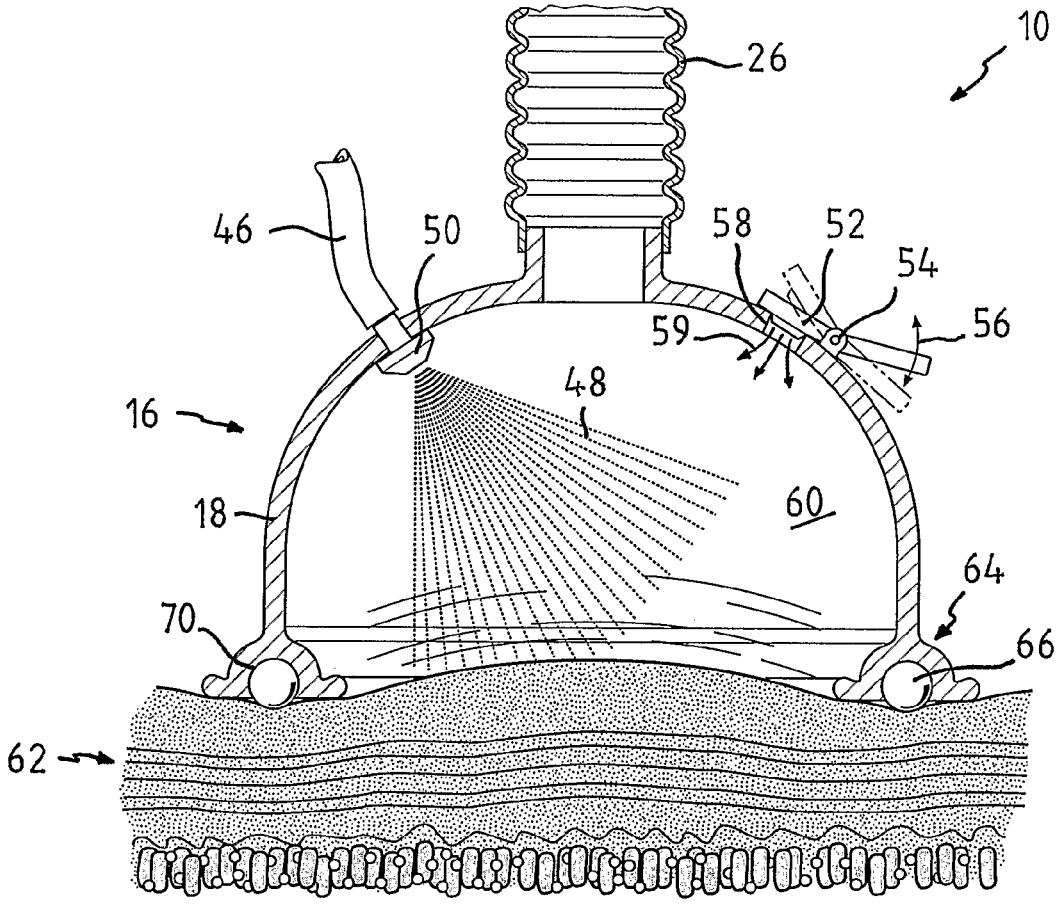
FIG. 2 is a side cut away view of one of the treatment devices of FIG. 1.

As further illustrated in FIG. 2, the cup 18 may include a release valve 52 that is adapted to pivot at hinge 54 when pressure is applied to the release valve 52 in the direction of arrow 56. In this way aperture 58 is exposed which allows atmospheric air to enter the cup 18 in the direction of arrows 59 thereby equalising the pressure within chamber 60 with the atmospheric pressure. The chamber 60 is formed when the cup 18 is placed against the surface of the skin 62. The release valve 52 enables the cup 18 to be removed from the surface of the skin 62. The perimeter 64 of the cup 18 may further include a rubber washer 66 housed within a channel 70 which acts to seal the chamber 60. The sealing means 66 ensures that the entire perimeter 64 of the cup 18 engages the surface of the skin 62, ensuring that a pressure differential is produced within the chamber 60 even when the cup 18 is placed on an uneven surface.

Figure 3:
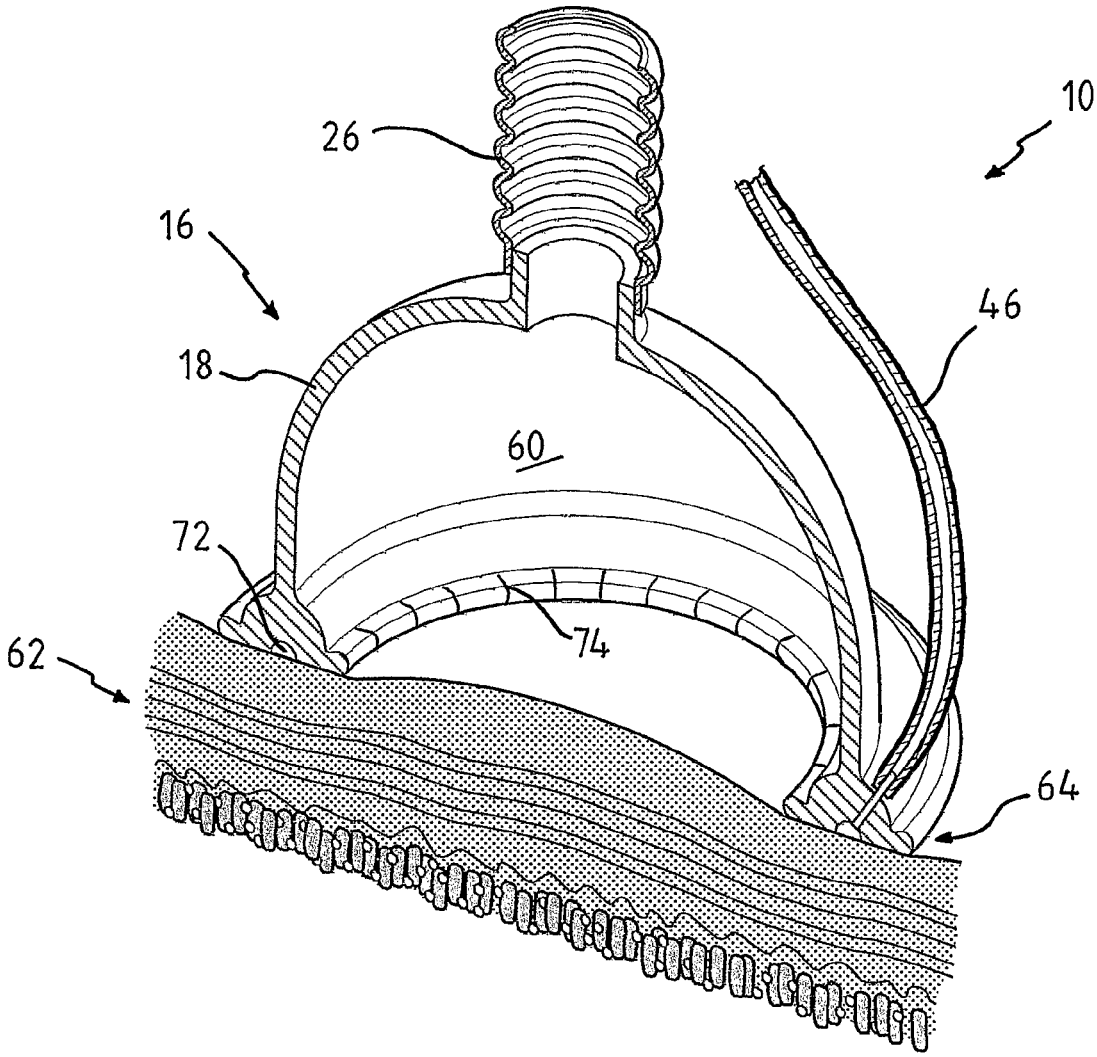
FIG. 3 is a side cut away view of a second embodiment of an apparatus for contouring and skin conditioning.

In an alternate embodiment, as illustrated in FIG. 3, the therapeutic substance 44 may be dispelled from tube 46 into a channel 72 that extends around the perimeter 64 of the cup 18. The therapeutic substance 44 is then able to flow through a series of grooves 74 into the chamber 60. This embodiment may be used to apply highly volatile substances 44, such as oils, to a patient 12 since these substances will be able to diffuse rapidly throughout the chamber 60.

Figure 4:
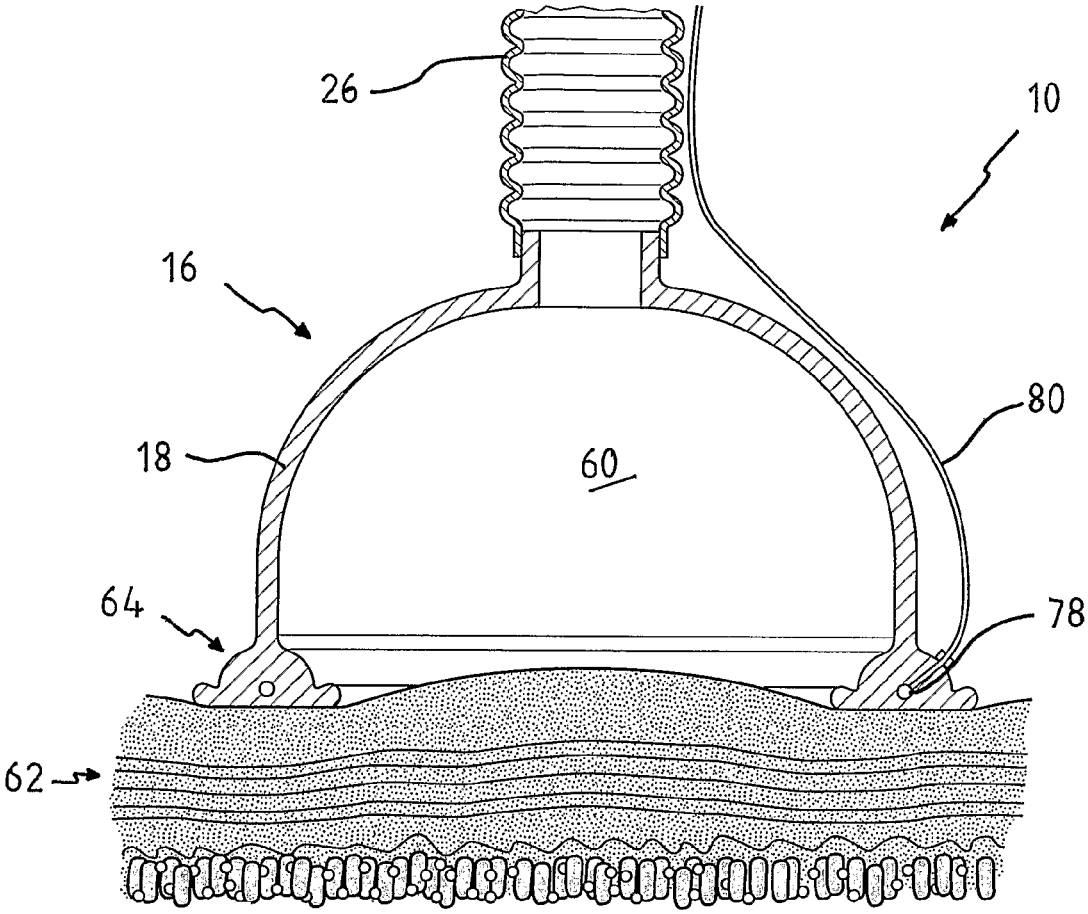
FIG. 4 is a side cut away view of a third embodiment of an apparatus for contouring and skin conditioning.

As illustrated in FIG. 4, the handpiece 16 may include a temperature regulator 78 adapted to affect the temperature of the skin 62. The temperature regulator 78 is connected to a power source (not shown) via cable 80. The temperature regulator 78, in the form of a heating element, extends around the perimeter 64 of the cup 18 in close proximity to the surface of the skin 62. The temperature regulator 78 heats the cup 18 which in turn heats the air contained within the chamber 60. However, the reader should appreciate that the invention is not limited to a heating element. The temperature regulator 78 may alternatively be configured to lower the temperature of the skin 62. For instance, cold air could be injected at regular intervals into the chamber 60 in close proximity to the surface of the skin 62.

Figure 5:
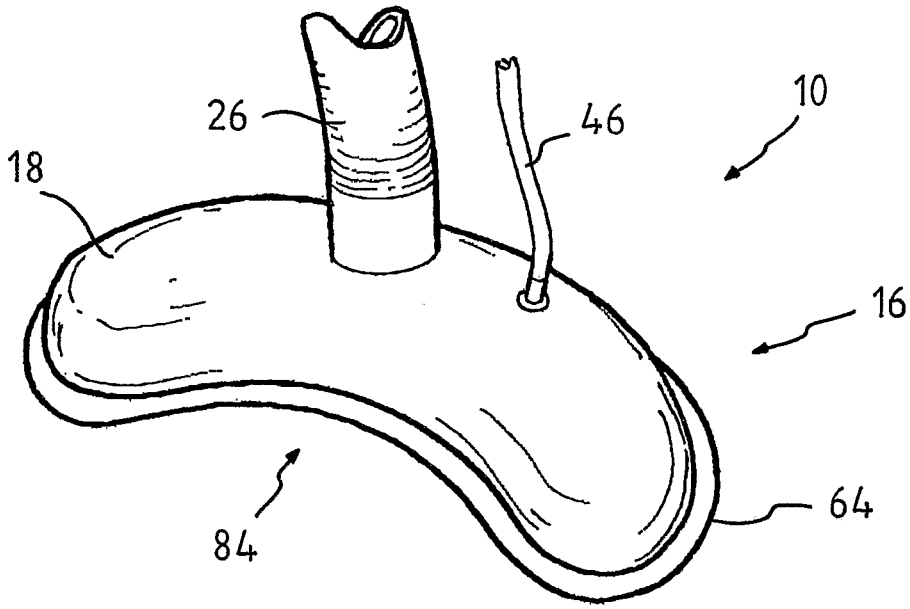
FIG. 5 is a perspective view of a fourth embodiment of an apparatus for contouring and skin conditioning.

Although larger areas such as thighs and buttocks are prone to cellulite, other smaller areas such as the face and neck may also be affected by cellulite or water retention and fat build up in the adipose tissue. For this reason, the cups 18 may be of varied shape and size depending upon the area of the patient 12 being treated. For instance, as illustrated is FIG. 5, the cup 18 may be kidney shaped 84 to facilitate the treatment of cellulite around the temples or on the cheeks. The reader will now appreciate that several different shaped cups 18 may be connected to a single vacuum source 14 to facilitate the treatment of a patient 12. Furthermore, there may be various sizes of cups 18 so that the treatment can be tailored to the specific physiological attributes of the patient 12. The reader should appreciate that the diameter of the tubes 26 may be varied or the fluid communication between different tubes 26 and the respective cup 18 may be restricted to provided different strengths of suction and compression for different cups 18. In this way, the cups 18 placed on sensitive areas of the patient's body can have a lower pressure differential.

Figure 6:
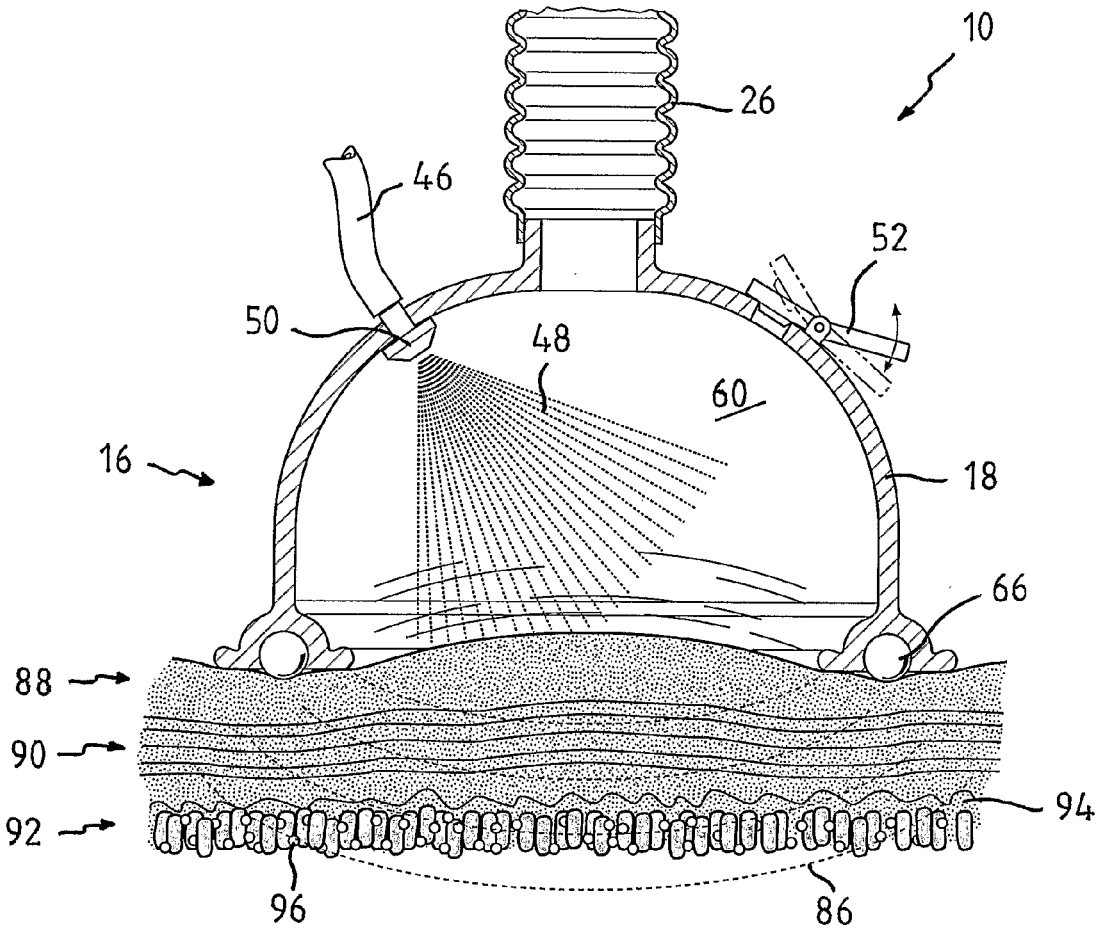
FIG. 6 is a side cut away view of one of the treatment devices of FIG. 1 illustrating how the apparatus produces vibrations in the subcutaneous fat layer.

During use of the apparatus 10 the pressure within the chamber 60 is varied by the vacuum source 14. This pulsing of the pressure within the chamber 60 creates vibrations 86, as illustrated by the semicircular perforated lines in FIG. 6. These vibrations 86 pass through upper layers of skin referred to as the epidermis 88 and dermis 90 layers. The vibrations 86 then pass into the subcutaneous fat layer 92. The subcutaneous fat layer 92 contains small projections of fat cells 94 that protrude into the dermis 90 giving the appearance of what is referred to as cellulite. These clusters of fat cells 94 also result in fluid retention which can further worsen the appearance of cellulite. By causing vibration of the subcutaneous fat layer 92 the apparatus 10 is able to help break apart the clusters of fat cells 94 and release the water molecules 96 held therein. This assists the lymphatic system in draining the excessive fat cells 94 and water 96 from the subcutaneous fat layer 92, thereby reducing the visible effects of a build up of cellulite.

The vibration, or more accurately resonate frequencies, of all matter, whether inorganic and organic, are specific and unique. Each tissue in the human body has individualized frequencies. The resonate frequency of organs such as the heart is around 6 Hz while the resonate frequency of skin is around 1 Hz. Fat cells have a different resonate frequency to muscles cells. Therefore, the frequency of vibration may be chosen to be close to the natural frequency of the fat cells thereby amplifying the affect of the apparatus 10. It should be appreciated by the reader that the frequency may be adjusted by use of the control valves 34 adapted to alter the strength and frequency of the vacuum and compression produced by the vacuum/compressor source 14 during operation. It is envisaged that the frequency of vibration within chamber 60 ranges from 10-200 Hz with high frequency vibrations in the range of 1-20 kHz, however, the reader should appreciate that the present invention is not limited to these pressures or frequencies.

Figure 7:
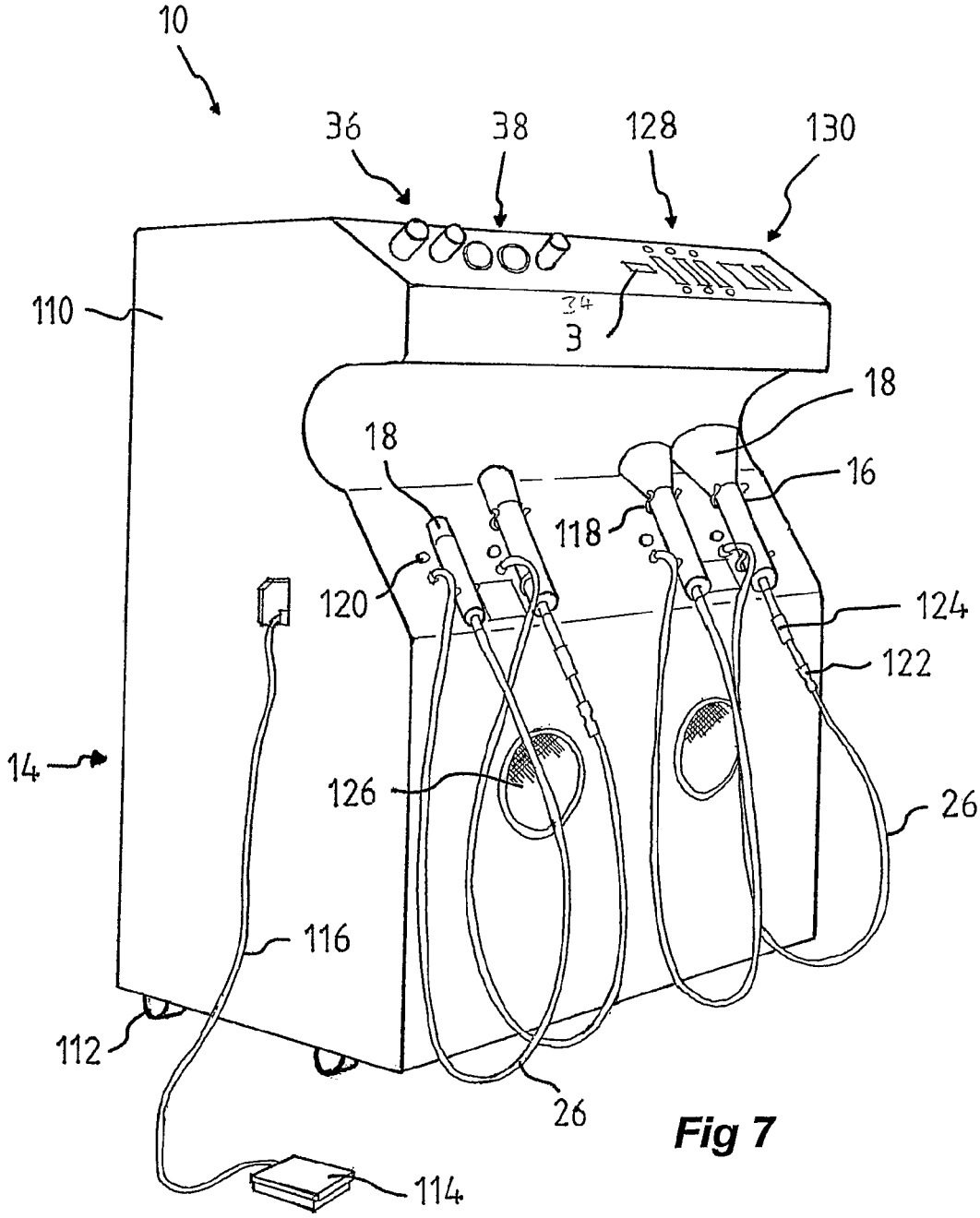
FIG. 7 is a perspective view of a fifth embodiment of an apparatus for contouring and skin conditioning.

In a preferred embodiment as illustrated in FIG. 7, the apparatus 10 include a console 110 adapted to house the vacuum/compressor source 14. The console 110 is mounted on legs or roller 112 to assist in the transportation of the apparatus 10. The apparatus further includes a foot peddle 114, connected to the vacuum/compressor source 14 by way of cable 116, which is adapted to control the operation of the apparatus 10, thereby facilitating ease of use. As illustrated in FIG. 7 the apparatus includes a plurality of mobile handpieces 16 with different sized cups 18. This ensures that the user does not have to replace the cup 18 every time a different size is required. The handpieces 16 are adapted to engage clips 118 on the front of the console 110. A light 120 corresponding to each mobile handpiece 16 indicates which device or devices are in use.

The tube 22 connected to the vacuum/compressor source 14 includes a venturi tube 122 adapted to regulate the passage of air therethrough and filter 124 to ensure that foreign material such as dirt does not enter the vacuum/compressor source 14 which could cause mechanical failure. The console 110 includes vents 126 to provide ventilation for the vacuum/compressor source 14. An instrument panel 128 is provided at the top of the console 110 and includes on/off switch 30, gauges 36, control valves 38 and auxiliary switches 130.

Figure 8:
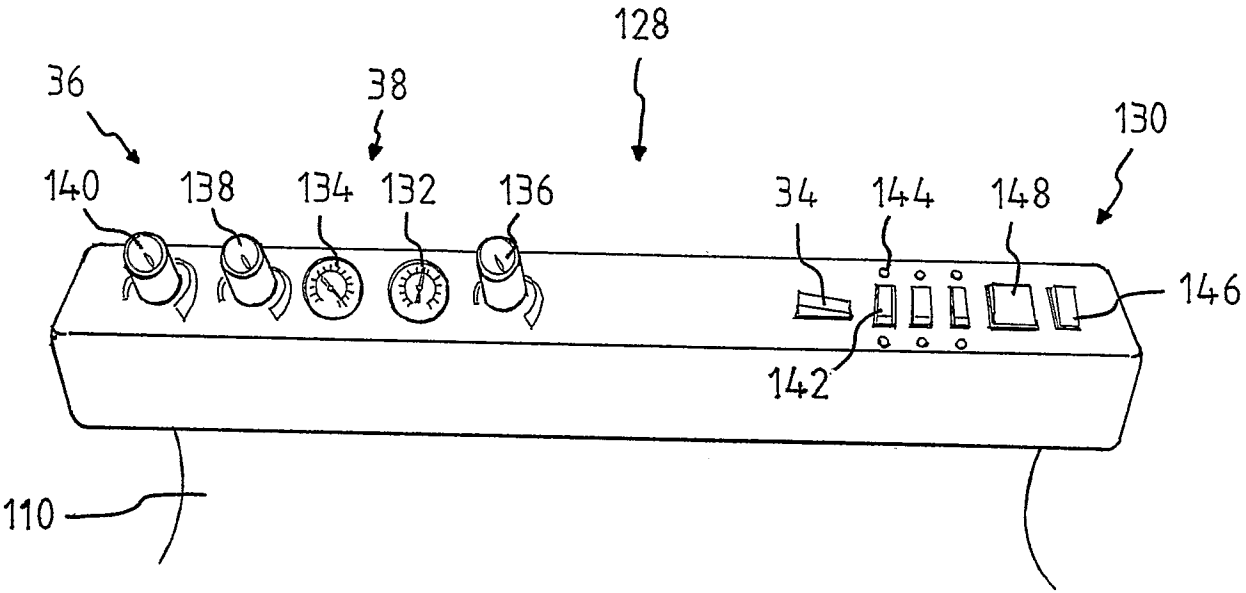
FIG. 8 is a front view of the control panel of FIG. 7.

As illustrated in FIG. 8 the control panel 128 includes gauges 132 and 134. Gauge 132 is adapted to measure the compressed air flow produced by source 14, corresponding switch 136 is configured to adjust the compressed air flow. Gauge 134 is configured to measure the vacuum produced by source 14. Corresponding switch 138 is adapted to adjust the production of the vacuum by source 14, while switch 140 is for fine adjustment. The control panel 128 further includes auxiliary switches 130 for controlling the operation of the apparatus 10. The auxiliary switches 130 include selector switches 142, with indicator lights 144, used for selection an individual handpieces 16, switch 146 and display panel 148. The reader should however appreciate that the present invention is not limited to this configuration of switches and gauges.

Figure 9:
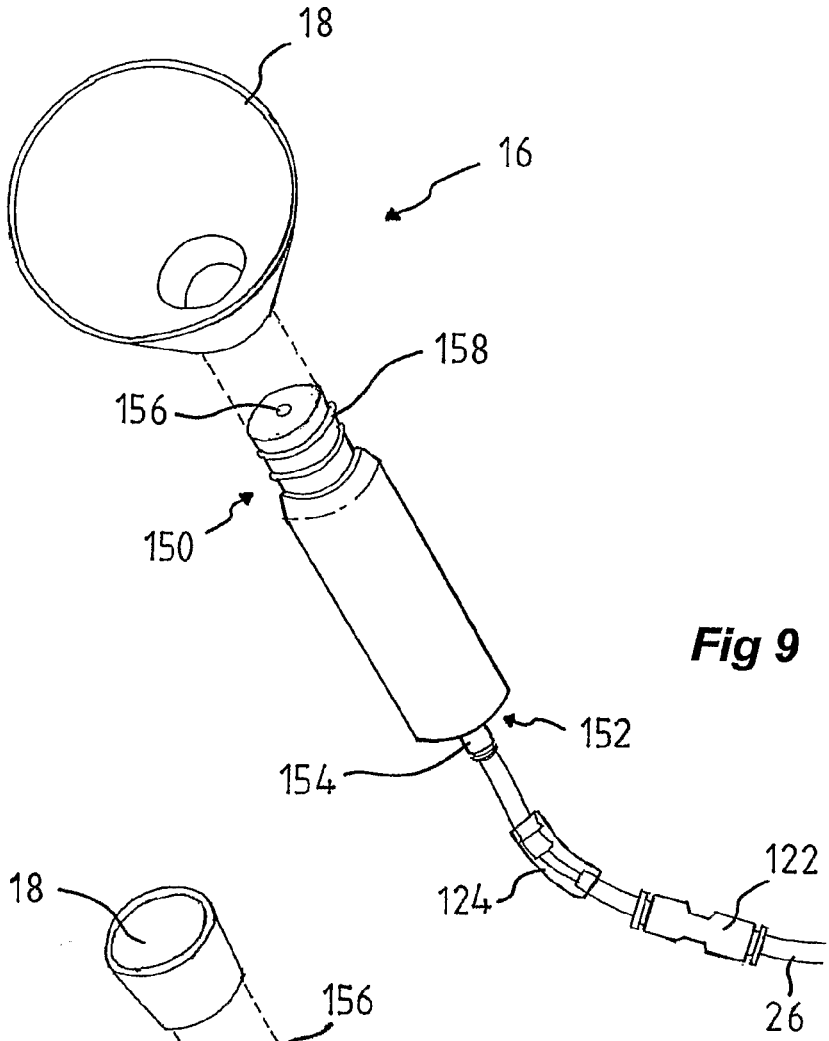
FIG. 9 is a perspective view of a handpiece of FIG. 7 illustrating a large cup.
Figure 10:
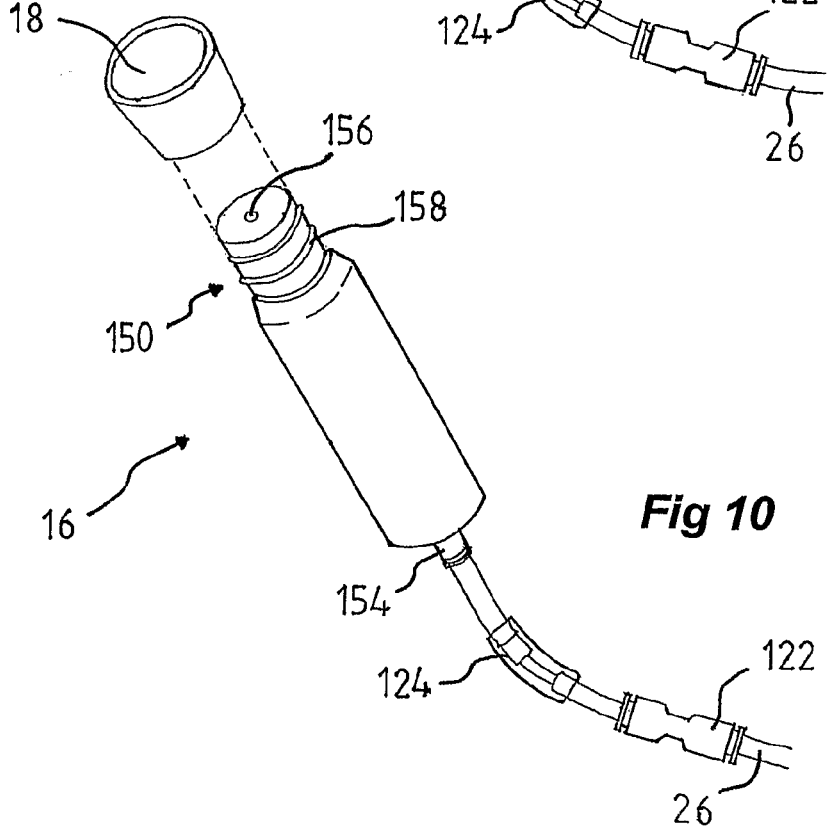
FIG. 10 is a perspective view of a handpiece of FIG. 7 illustrating a small cup.

FIGS. 9 and 10 illustrate an individual handpiece 16 engaging different sized cups 18. The handpiece 16 includes a first end 150 adapted to engage a cup 18 and a second end 152 which includes a boss 154 adapted to connect to tube 26. The first end 150 includes an aperture 156 in communication with tube 26 and a series of O-rings 158. The cup 18 slidably engages the first end 150 and is held in place by the frictional force of the O-rings 158 as is well known in the art.

Figure 11:
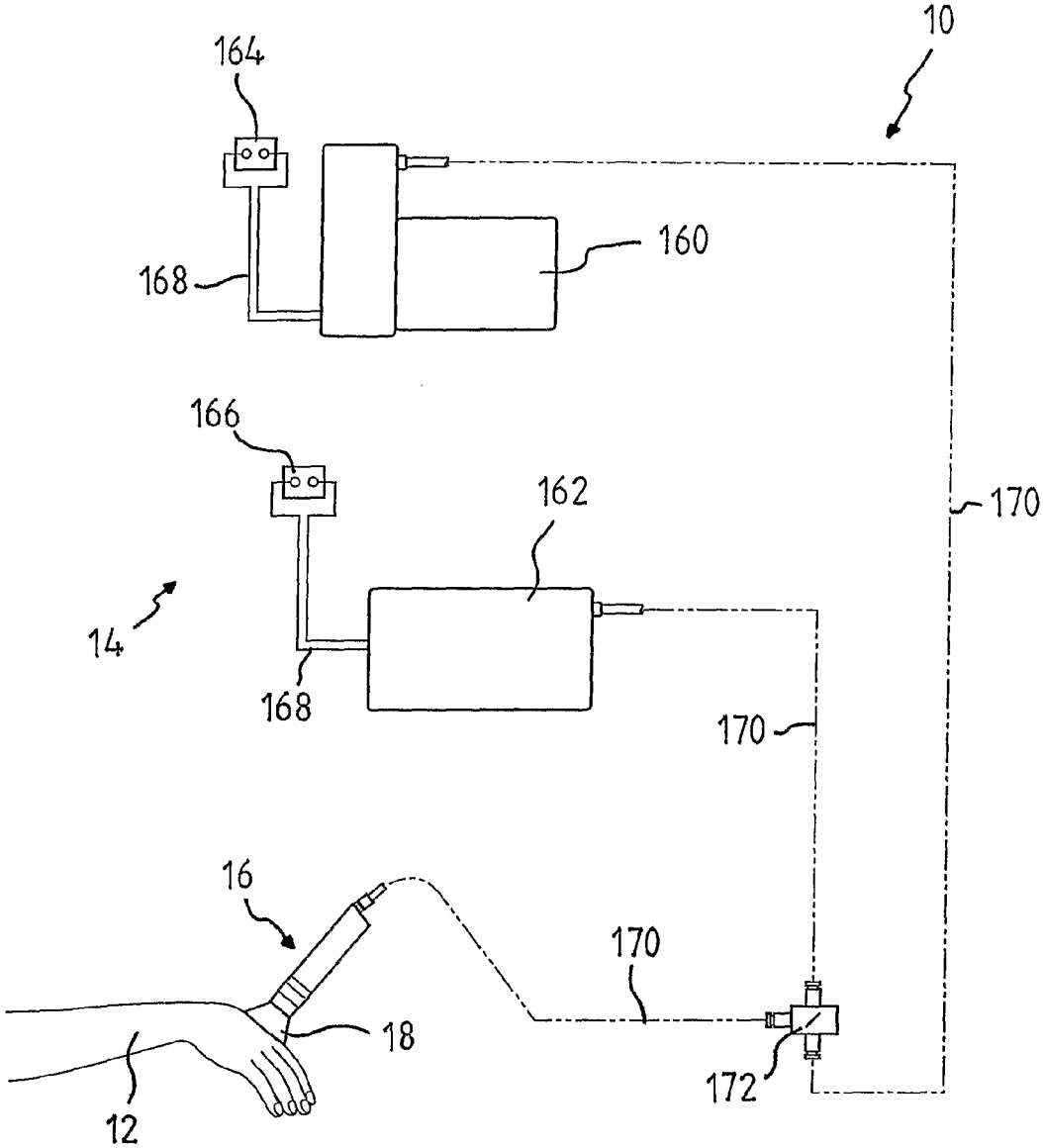
FIG. 11 is a schematic view of the compressor and suction device of the apparatus of FIG. 7.

As illustrated in FIG. 11, the vacuum/compressor source 14 includes a vacuum producing device 160 and a compressor 162. The vacuum producing device 160 and compressor 162 are connected to respective power sources 164 and 166 by way of electrical cables 168. The vacuum producing device 160 and compressor 162 are in communication 170 with selector switch 172. The selector switch 172 determines which of the devices 160 or 162 is in communication 170 with the handpiece 16. This produces a cyclic oscillation of the pressure within cup 18, from a higher than atmospheric pressure to a lower than atmospheric pressure.

Figure 12:
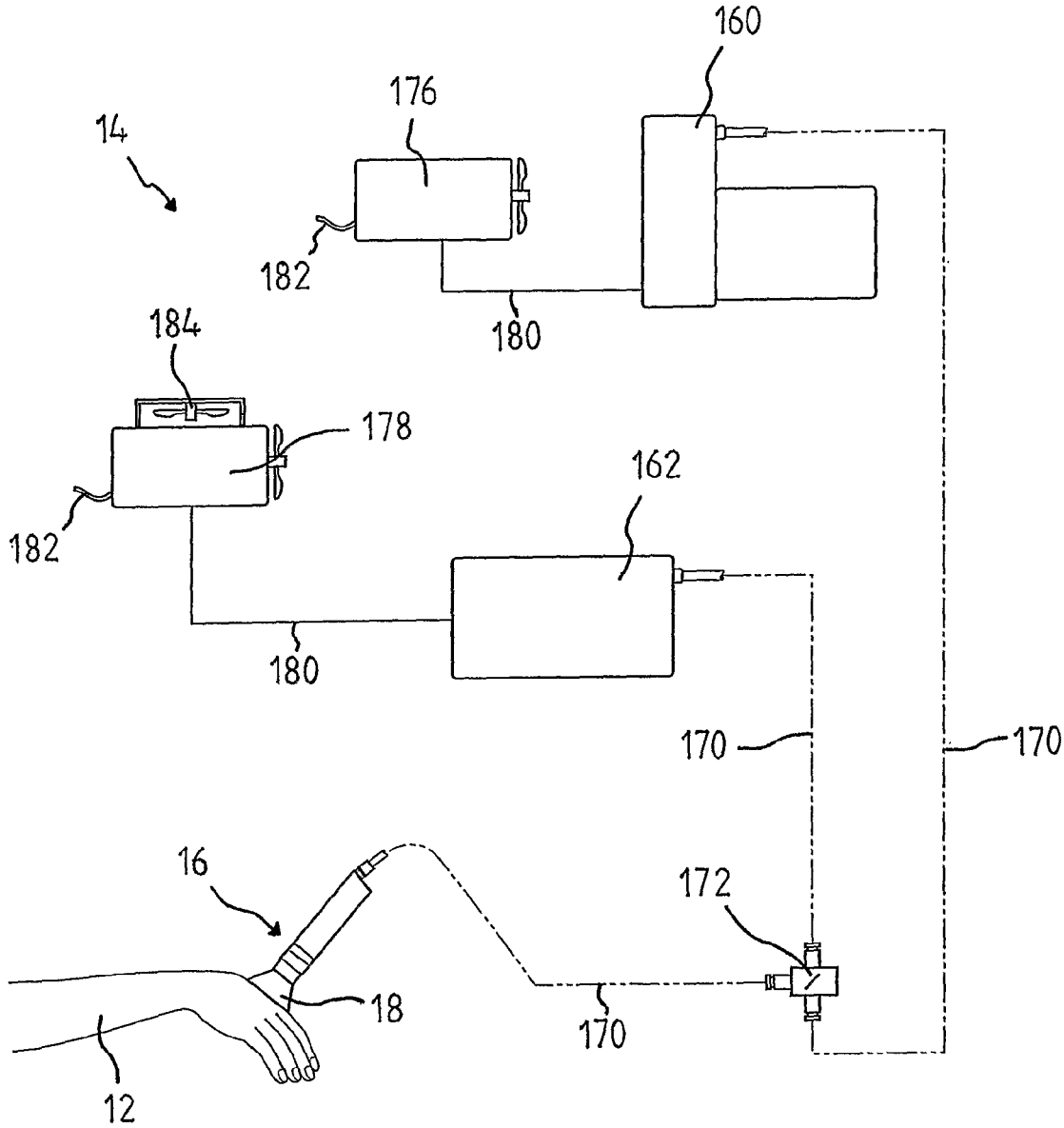
FIG. 12 is a schematic view illustrating an alternate arrangement of the compressor and suction device of the apparatus of FIG. 7.

As illustrated in FIG. 12, vacuum producing device 160 and compressor 162 are connected to respective electric motors 176 and 178 by way of cables 180. Motors 176 and 178 are connected to a power source by way of electrical cable 182. The motor 178 corresponding to compressor 162 includes an additional fan 184 to assist in cooling.

Figure 13:
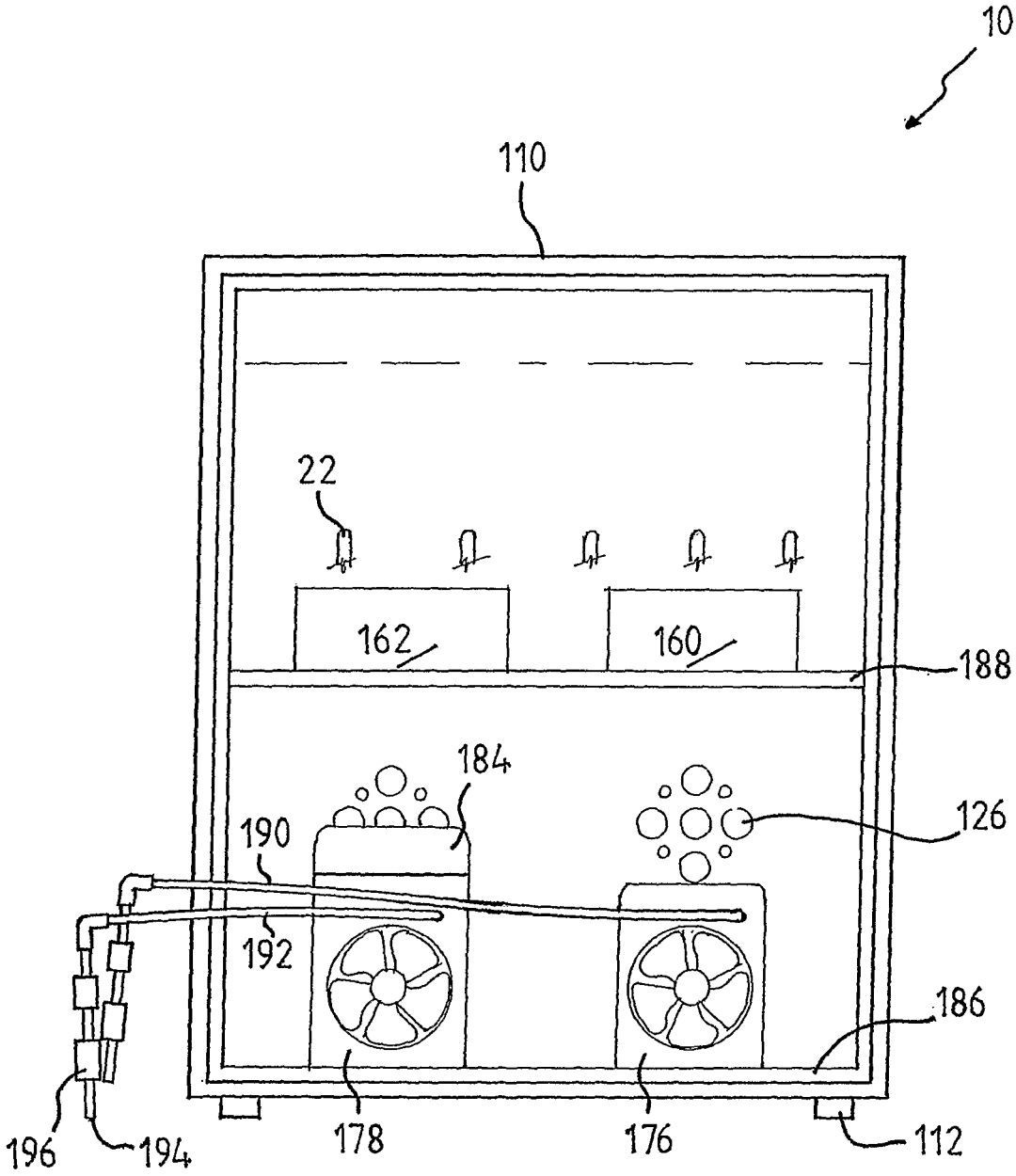
FIG. 13 is a rear view of the apparatus of FIG. 7.

FIG. 13 illustrates the rear of the console 110 with the back panel removed. The motor 176 and 178 are mounted on the base 186 of the console 110 adjacent to vents 126. The vacuum producing device 160 and compressor 162 are mounted on shelf 188. Inlet tubes 190 and 192 are configured to supply air to vacuum producing device 160 and a compressor 162 respectively, which are in fluid communication with handpiece 16 through pipes 26. The supply tubes 190 and 192 include an opening 194 and filters 196.

Figure 14:
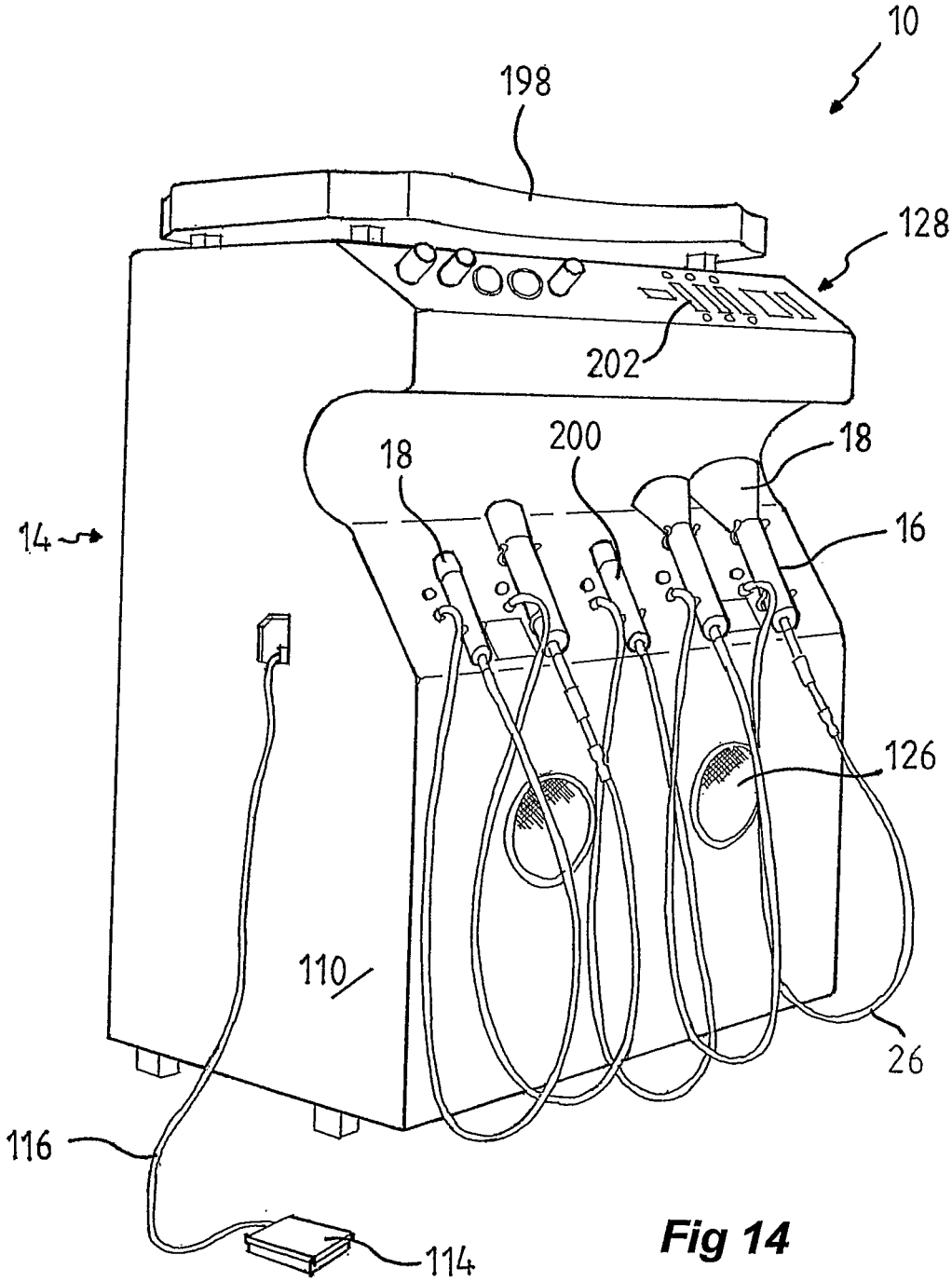
FIG. 14 is a perspective view of the apparatus of FIG. 7 illustrating the use of additional treatment devices.

As illustrated in FIG. 14, the apparatus 10 can be used in conjunction with additional treatment devices, including electrical signal applicator 198 and oxygen infusing handpiece 200 which is controlled by switch 202.

It should be appreciated by the reader that the present description provides, by way of example, one arrangement in which the principles of the present invention may be employed. It should however be appreciated that the present invention is not limited to this particular embodiment. It has been described that an air compressor and vacuum source alternately communicate with the cup, however, it should be appreciated that any device could be used to produce a pressure differential. It has also been discussed that the pressure within the cup alternates between two states; one of greater than atmospheric pressure and the other of lower than atmospheric pressure. It should however be appreciated that the pressure within the cup does not need to be lower than atmospheric pressure. The pressure states within the cup 18 could alternate both be greater than atmospheric pressure.

The skilled addressee will now appreciate the many advantages of the present invention for an apparatus and method of body contouring and skin conditioning. The invention provides a non-invasive method for treating cellulite and adipose tissue that overcomes many of the limitation of currently available treatments. The apparatus 10 provides a treatment that reduces the visible signs of cellulite and adipose tissue by assisting the drainage of the lymphatic system with minimal discomfort to the patient. As the reader will now appreciate the use of pulsating pressure within the chamber 78 creates vibrations that pass through into the subcutaneous fat layer. This avoids the use of an aggressive massage of the underlying tissue which can result in such problems as bruising and which is not suitable for some people including those who are pregnant. The present method also means that there is less impact on the operator thereby reducing the risk of repetitive strain injuries. As the reader will now appreciate the present invention provides an exemplary way of treating cellulite and adipose tissue that is both gentle on the patient and operator.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In the summary of the invention and the claim which follow, except where the context requires otherwise due to express language or necessary implication, the word "comprising" is used in the sense of "including", i.e. the features specified may be associated with further features in various embodiments of the invention.

What is claimed is:

1. An apparatus for body contouring and skin conditioning comprising:

a source of compressed gas adapted to produce a stream of compressed gas;

a vacuum source adapted to produce a vacuum;

a handpiece having a passageway therethrough, wherein said handpiece is in communication with said source of compressed gas and said vacuum source;

a valve adapted to selectively control the communication of said source of compressed gas and vacuum source with said handpiece; and a cup adapted to releasably engage said handpiece and having a first opening and a second opening, wherein said first opening is defined by a perimeter which when placed against a skin surface defines a chamber, and wherein said second opening is in communication with said handpiece;

wherein an oscillating pressure between about 10 Hz and about 200 Hz is produced within said chamber thereby causing the skin surface to vibrate.

2. The apparatus of claim 1, wherein said cup is adapted to slidably engage said handpiece.

3. The apparatus of claim 2, wherein said handpiece includes at least one O-ring which is configured to frictionally engage an inner surface of said cup.

4. The apparatus of claim 1, wherein said cup comprises a plurality of cups having different dimensions and wherein each of said plurality of cups can be selectively attached to said handpiece.

5. The apparatus of claim 4, wherein said handpiece can be selectively operated with each of said cups attached thereto.

6. The apparatus of claim 4, wherein said handpiece comprises a plurality of different handpieces and wherein said plurality of handpieces can be simultaneously operated.

7. The apparatus of claim 1, wherein said handpiece comprises a plurality of handpieces and wherein said cup comprises a plurality of cups having different sizes.

8. The apparatus of claim 1, wherein said source of compressed gas comprises an air compressor.

9. The apparatus of claim 1, wherein said source of compressed gas comprises a cylinder of compressed gas.

10. The apparatus of claim 1, wherein said oscillating pressure within said chamber can be adjusted.

11. The apparatus of claim 1, wherein said apparatus includes a foot pedal adapted to control said oscillating pressure within said chamber.

12. The apparatus of claim 1, wherein said apparatus includes at least one control valve adapted to alter said oscillating pressure within said chamber.

13. The apparatus of claim 1, wherein said apparatus includes a release valve for increasing said oscillating pressure within said chamber.

14. The apparatus of claim 1, wherein said handpiece is connected to said source of compressed gas and said vacuum source by way of a flexible hose.

15. The apparatus of claim 1, wherein said apparatus includes a device for applying a therapeutic substance to the skin surface.

16. The apparatus of claim 1, wherein said apparatus includes a temperature regulator for affecting the temperature of the skin surface during operation of said apparatus.

* * * * *